US005725251A

United States Patent [19]

Heggeland

[11] Patent Number: 5,725,251

[45] Date of Patent: Mar. 10, 1998

[54] MODULAR BINDER SYSTEM

[76] Inventor: Bruce E. Heggeland, 1480 Exeter Ct., Barrington, Ill. 60610

[21] Appl. No.: 642,301

[22] Filed: May 3, 1996

[51] Int. Cl.[6] ..... B42D 3/00

[52] U.S. Cl. ..... 281/48; 281/21.1; 281/45; 281/15.1

[58] Field of Search ..... 281/21.1, 15.1, 281/48, 45, 42, 51; 402/79, 80 R, 80 P

[56] References Cited

U.S. PATENT DOCUMENTS 4,521,035 6/1985 Berezowsky ..... 281/48

5,031,936 7/1991 Vannier ..... 281/21.1

5,037,137 8/1991 Ozeki ..... 281/48

*Primary Examiner*—Willmon Fridie, Jr.

*Attorney, Agent, or Firm*—Banner & Witcoff, Ltd.

[57] ABSTRACT

A modular binder system that includes modular binder backing section that may be interlocked in the lateral direction and in receipt of various item holders. Numerous types and designs of item holders coact with the backing sections to form a book-like binder system.

1 Claim, 21 Drawing Sheets

FIG.19
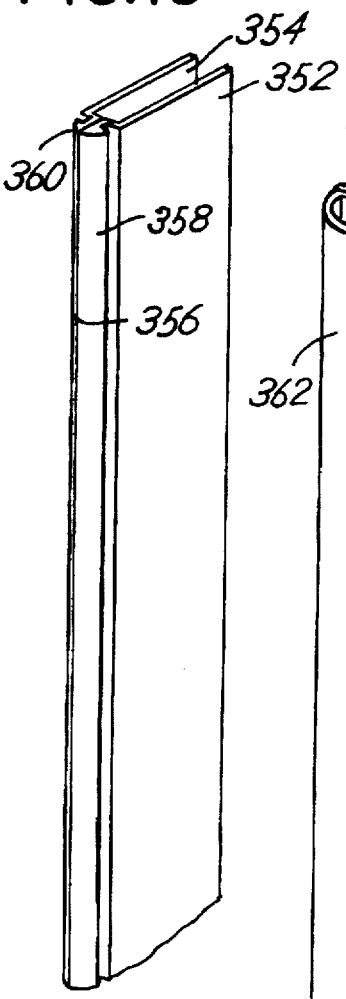
FIG.18
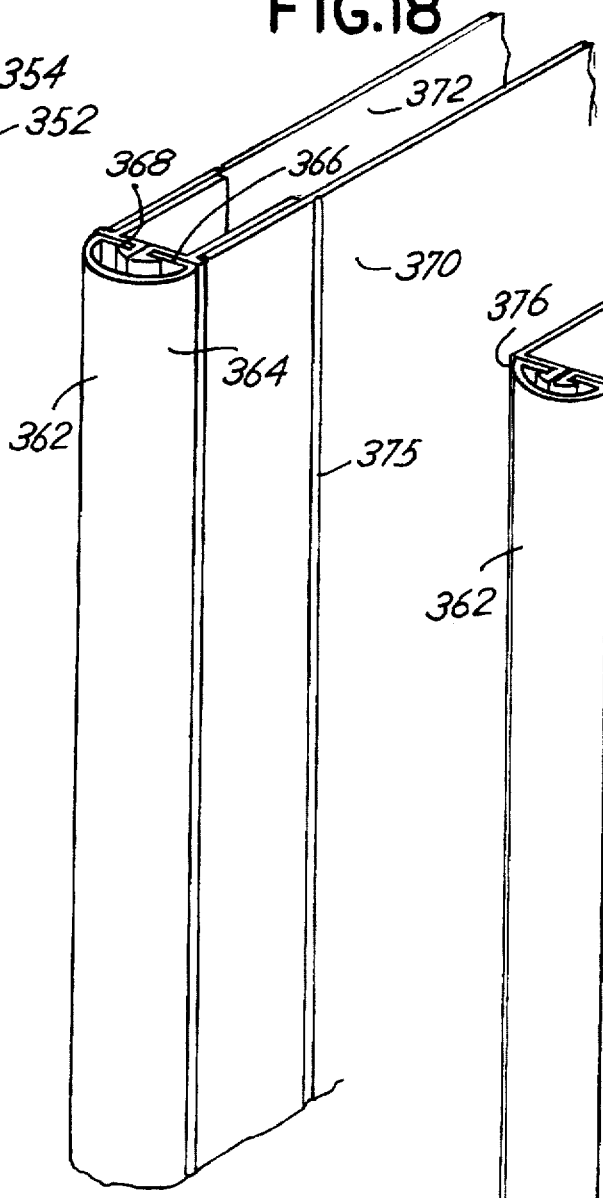
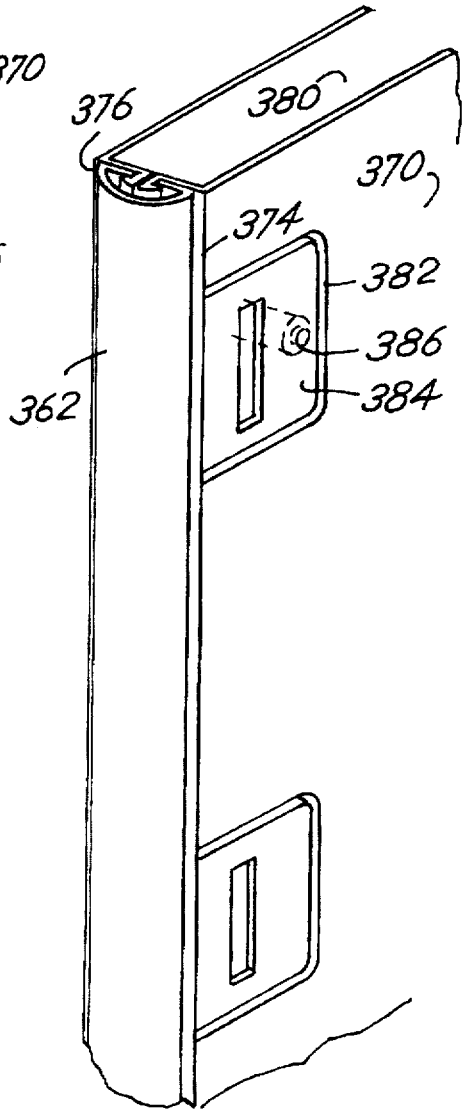
FIG.17

MODULAR BINDER SYSTEM

BACKGROUND OF THE INVENTION

This invention relates to a binder construction or system for binding any of a multiplicity of items such as pages, folders, three-ring binders and other items.

Heretofore when multiple pages were to be bound, various types of binding systems have been developed including three-ring binders, two- and three-hole punch fasteners, spiral metal spring binders and the like. There remains, however, a need to provide a binding system or binder that can accommodate numerous types of items to be bound, including folders, pages and the like. The invention contemplates an improved binding system that is modular and may be expanded to retain numerous types of items such as pages, folders, etc. of various widths, heights and bulk.

SUMMARY OF THE INVENTION

Briefly, the invention comprises molded or extruded modular binder sections made from a plastic material. The sections include a back or spine having an interlocking mechanism so that adjacent sections can be attached, one to the other, to form a full binder. Also, each modular binder section includes an internal item gripping section which is adapted to receive any one of a number of item holders such as a page holder, a folder holder, a three-ring binder, a cassette container holder, a disk container holder and other holders.

Thus, it is an object of the invention to provide an improved modular binder system.

It is a further object of the invention to provide a modular binder system that is adapted to accept multiple types of items such as paper, three-ring binders, folders and the like.

Yet another object of the invention is to provide a modular binding system that is adapted to be adjustable in width or number of elements included in the binder.

These and other objects, advantages and features of the invention will be set forth in the detailed description that follows.

BRIEF DESCRIPTION OF THE DRAWING

In the detailed description which follows, reference will be made to the drawing comprised of the following figures:

FIG. 17 is a holder of the type which is utilized in combination with the binder section and that also has the dual capability as acting as a separate binder;

FIG. 18 is an alternative construction to that shown in FIG. 17;

FIG. 19 is an element of the holder shown in FIG. 18.

DETAILED DESCRIPTION OF THE PREFERRED EMBODIMENT

Figure 1:
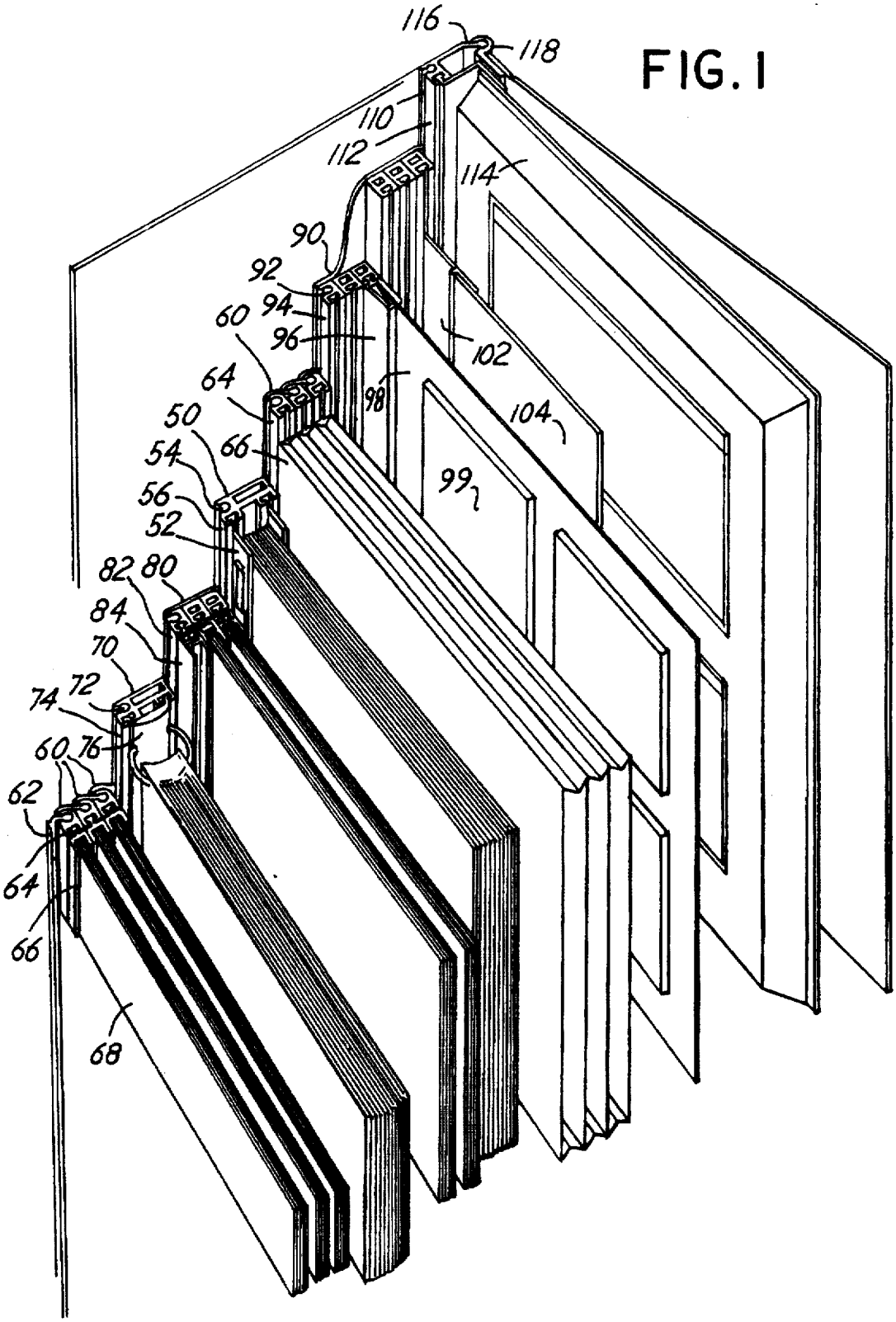
FIG. 1 is an isometric view of an improved modular binder system of the invention in a form incorporating numerous item holders.

FIG. 1 depicts, the improved modular binder system of the invention with various alternative item holders. Briefly, the binder system includes two basic components or elements. The first major element of component, which may be made in a number of separate forms to be described below, constitutes a binder section 50. The binder section 50 cooperates with the second basic separate element, which is an item holder or insert element 52. Numerous alternative binder elements 50 and insert elements 52 coact to hold various items including paper, folders, envelopes and a myriad of other items. The binder section 50 may be provided in a series of sizes and configurations, though typically with a modular width. The modular binder sections 50 can be combined in many different ways to provide a binder that will cooperate with multiple holders 52 to hold multiple items.

Thus, in review, and referring specifically to FIG. 1, the binder system of the invention includes a modular binder section 50 that includes an outer back or spine 54 and an inner, item gripping section or channel 56. The inner section 56 is cooperative with or coactive with a separate item holder 52. Separate modular binder back sections 50 cooperate or engage with one another laterally in order to build an entire binder configuration. Various types of item holders 52 coact with the inner gripping section 56 of the separate modular binder back elements or sections 50. FIG. 1 illustrates a wide variety of modular binder back elements 50 and item holders 52. Thus referring to FIG. 1, there is illustrated, a series of three identical modular sections 60 connected to each other, one of which cooperatively receives a cover 62. The modular binder sections 60 include inner item gripping channels 64 each of which is adapted to cooperate with an insert module or item holder 66. In the embodiment depicted, the holder 66 is designed to retain or hold a series of separate pages 68.

Another modular binder back section 70 includes an outer spine or back 72 coactive with and connectable to the spine or back 72 of an adjacent or laterally adjacent modular binder back section 60 or 70 so as to form a composite binder having a book-like appearance. The element 70 includes an inner item gripping channel 74 that cooperatively receives a three-ring binder insert 76.

Another modular binder back section 80 is fabricated to include a multiple of inner item gripping channels 82. Each channel 82 is designed to be cooperative with a single, uniquely constructed page item holder 84. In the embodiment shown, three separate item holders 84 coact with a single modular binder back section 80, which has three channels 82.

Next, continuing to refer to FIG. 1, there is depicted a modular binder back section 50 that has its own unique outer spine or back 54 and an inner item gripping channel 56 cooperative with a particular item holder 52. The next adjacent modular binder back section 60 has the form of the back section 60 previously described. The inner item gripping channel 64 coacts with a multi-pocket item holder folder 66 that constitutes an item holder 66.

The next adjacent modular binder back section 90 has a construction similar to the back channel 80. It includes an outer back or spine 92 and an inner item gripping or retention channel 94 which cooperates with, by way of example, an item holder or module 96 that, in turn, is adapted to receive and hold a sheet 98 on which photos, for example, or other items 99 are retained. The modular binder back section 90 may also cooperate with alternative types of holders, for example, holder 102 that is attached to or retains a placard 104.

Another modular binder back section 110 includes an inner retention or item gripping channel 112 that co-acts with an item holder or insert module 114 fashioned to hold, for example, a video cassette. The modular binder back section 110 also includes an outer back or spine 116 that may cooperate with a separate cover element 118. The characteristics of the various modular binder back sections and item holders are discussed in further detail with respect to the remaining figures.

Figure 2:
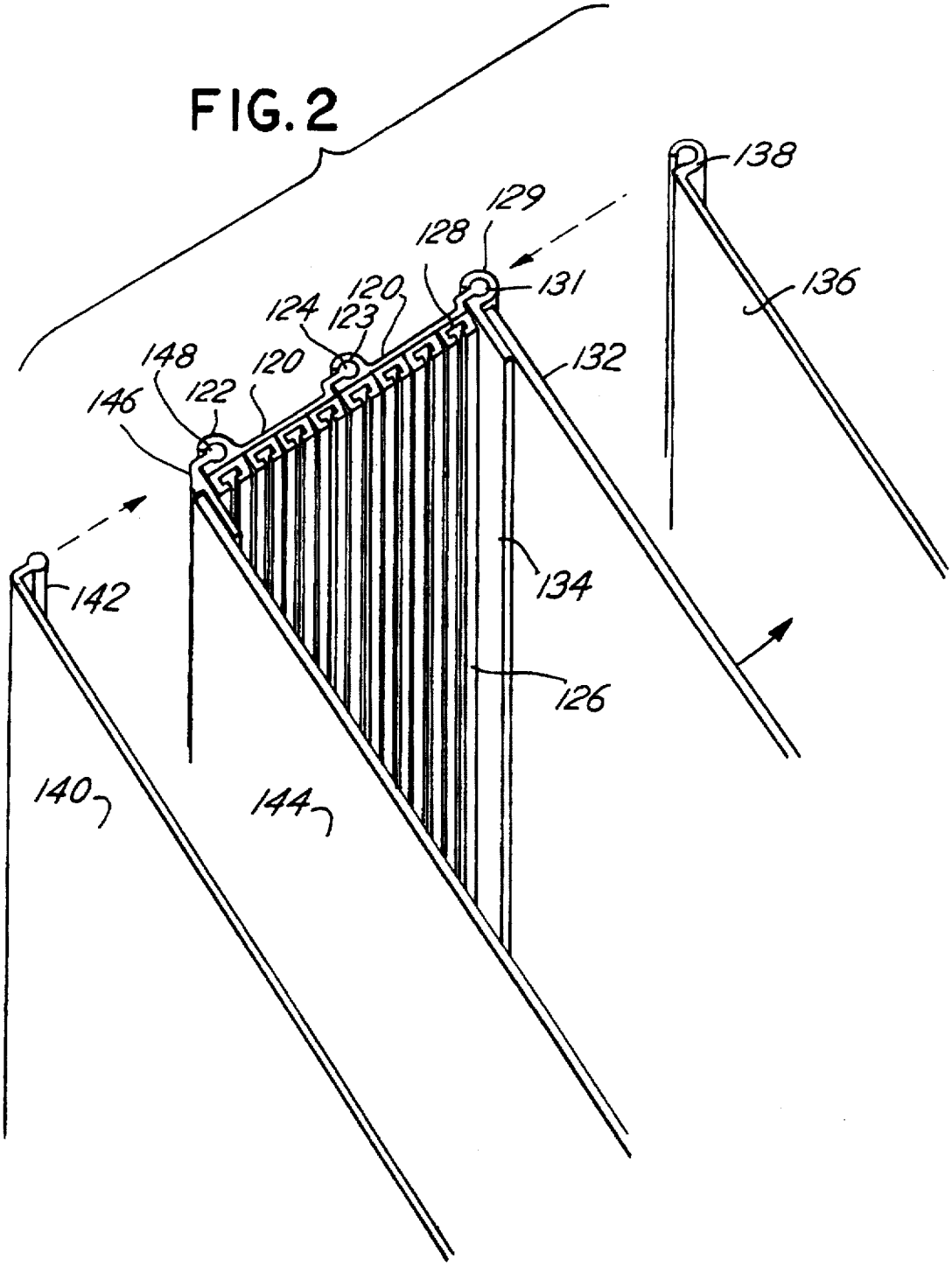
FIG. 2 is an isometric view of the modular binder system of the invention depicting various optional item holders.

FIG. 2 illustrates a series of two substantially identical modular binder back sections 120. Each of the modular binder back sections 120 includes an outer spine 122 that includes an elongated, lateral, longitudinal slot 123 adapted to slidably receive a rib 124. Thus, the slot 123 extends the entire height of the back section 120 and is adapted to slidably receive the elongated rib 124 which is affixed to the adjacent back section 120. Thus, each back section 120 is substantially identical and modular, having a lateral or side slot 123 on one side and a rib 124 on the opposite side sized to slidably fit in the slot 123. In this manner, adjacent sections 120 may be joined or interlocked to form a binder capable of holding numerous types of items. Each backing section 120 further includes an inner retention or gripping channel. In the embodiment depicted, each modular element or section 120 includes four (4) inner retention or channels sections 126. Each inner retention channel includes a shaped longitudinal slot 128. Each slot 128 has a T-shaped cross-section and is parallel to slot 123 and rib 124. The T-shaped cross-section slot 128 is adapted to receive and retain the item holders or modules as depicted in subsequent figures.

Note that the vertical rib 124 may coact with a cover module 129 that includes a longitudinal slot 131 adopted to receive rib 124. A cover sheet 132 may attach to a cover flange 134 or be molded integrally as cover 136 with the longitudinal rib 124 of cover module 129. The cover sheet 132 may be pivoted in the direction indicated by the arrow in FIG. 2 about the axis of the rib 124 or about a living hinge molded in flange 134. As also depicted in FIG. 2, an optional cover 140 has a longitudinal rib 142 cooperative with a longitudinal slot 122 the modular binder back section 120. Again, as an alternative to the integrally molded cover 140, a separate cover 144 may be attached to a hinge-type member 146 that includes a longitudinal rib 148 cooperative with the slot 123 in the outer back section 120.

Figure 3:
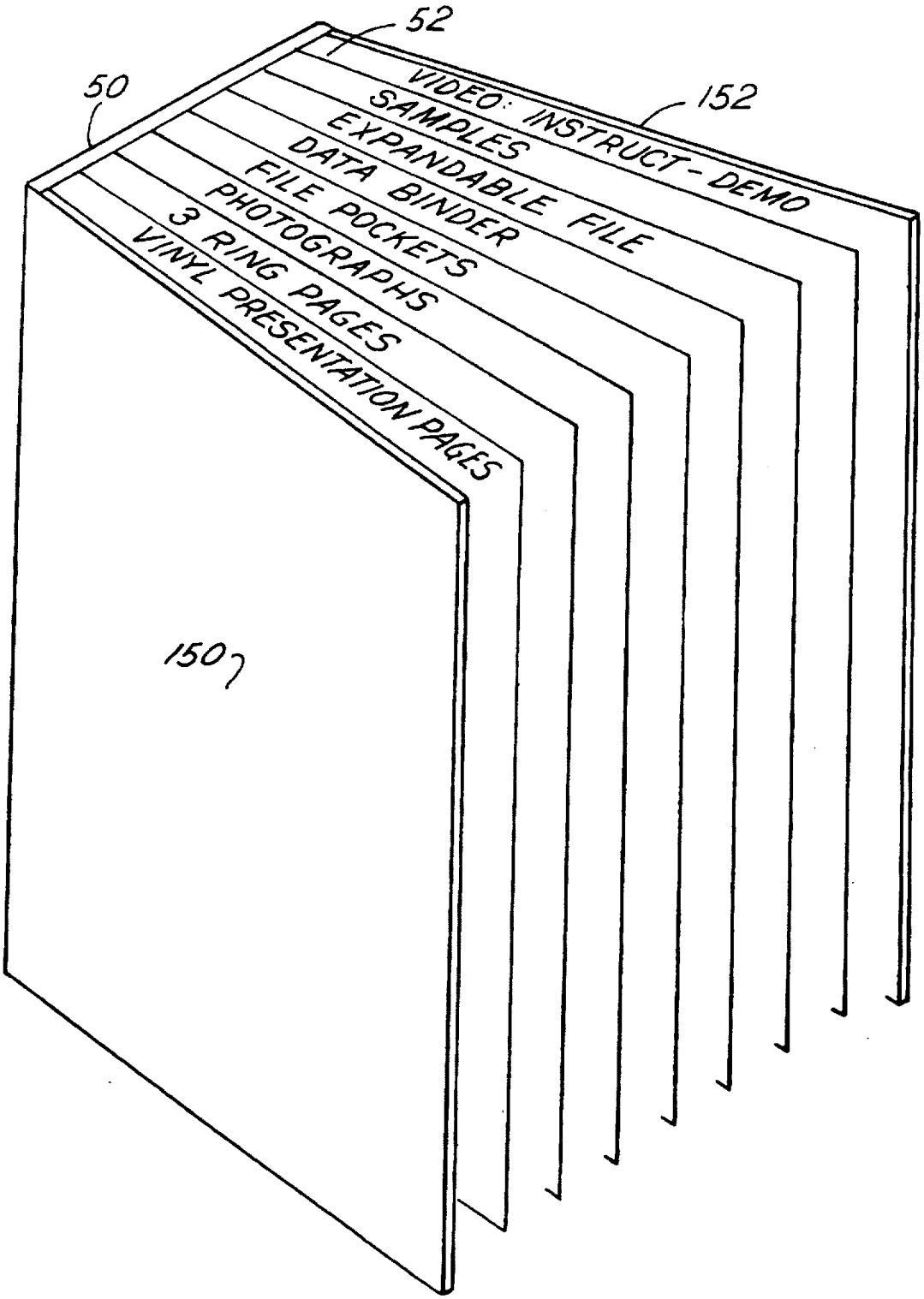
FIG. 3 is an isometric view of an assembled binder.

FIG. 3 depicts an assembly of various types of binder back sections in combination with item holders or modules to provide a customized assembly in a book-like form utilizing the modular system of the invention. Thus, the assembled book-like construction depicted in FIG. 3 includes a front cover 150 and a back cover 152. The covers 150 and 152 are interconnected by a series of one or more modular binder back sections 50. Item holders 52 are connected to the sections 50 to form a total package.

Figure 4:
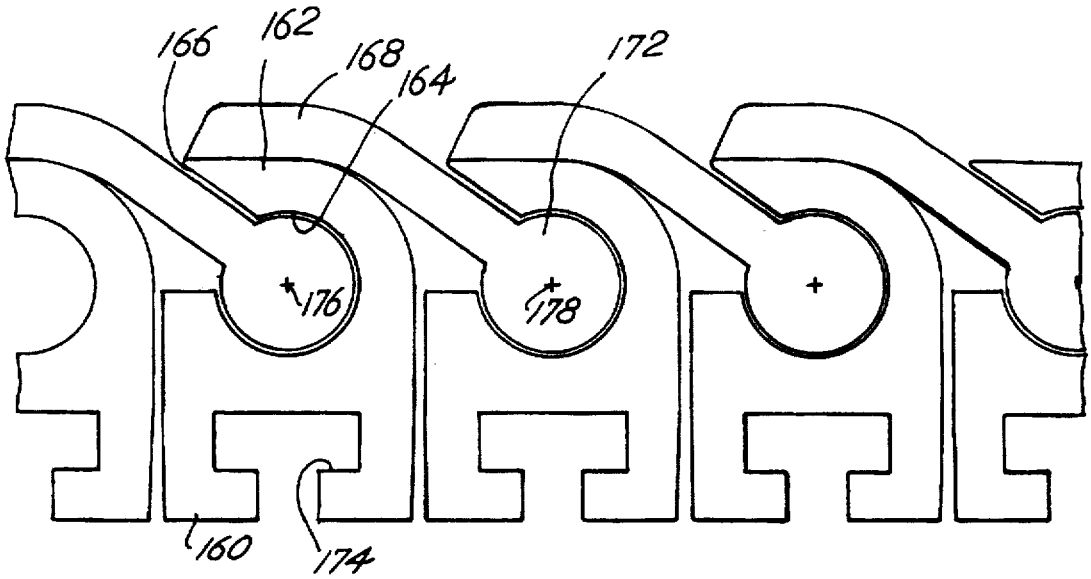
FIG. 4 is an enlarged cross-sectional view of one version of binder sections forming a total binder.

FIG. 4 is a cross-sectional view of one of the multiple alternative modular binder back sections that may be manufactured by extrusion molding techniques, for example, and then assembled. Referring to FIG. 4, therefore, a typical section 160 includes an outer spine or back 162. The function of the spine 162 is to provide a means by which laterally adjacent sections 160 may be attached together. Thus, there is a longitudinal slot 164 that is generally aligned with the height of the binder assembly and defines a pivot axis. The slot 164 connects with a lateral passage 166 adapted to receive a rib 172 associated with a laterally adjacent section 160. Each section 160 thus includes a laterally projecting arm 168 that terminates with a longitudinal rib 172 adapted to fit into a slot 164 of a laterally adjacent section 160.

Section 160 further includes a channel with a receiving slot 174 that, in the embodiment shown, is a T-shaped cross-section receiving slot 174 designed to receive an item holder or module to thereby retain the module in combination with the section 160. Although a T-shaped cross-section slot 174 is depicted, other shaped slots, including a slot with a circular shape, such as slot 164 as depicted with respect to the section 160 that may be utilized for a channel in the practice of the invention.

It should be noted that the section 160 has a modular type of construction in that the distance from the center line axis 176 of an section 160 to the center line axis an adjacent section 160 is substantially equal to the lateral dimension of each section 160 or very slightly greater than said distance.

The section 160, as mentioned, is preferably molded by extruding plastic material. Additionally, the plastic material which is extruded is preferably a type which is flexible so that connecting arms 168 may be flexible. Thus the assembly may be flexed when multiple sections 160 are connected one to the other thereby giving the assembly a book-like characteristic.

Figure 5:
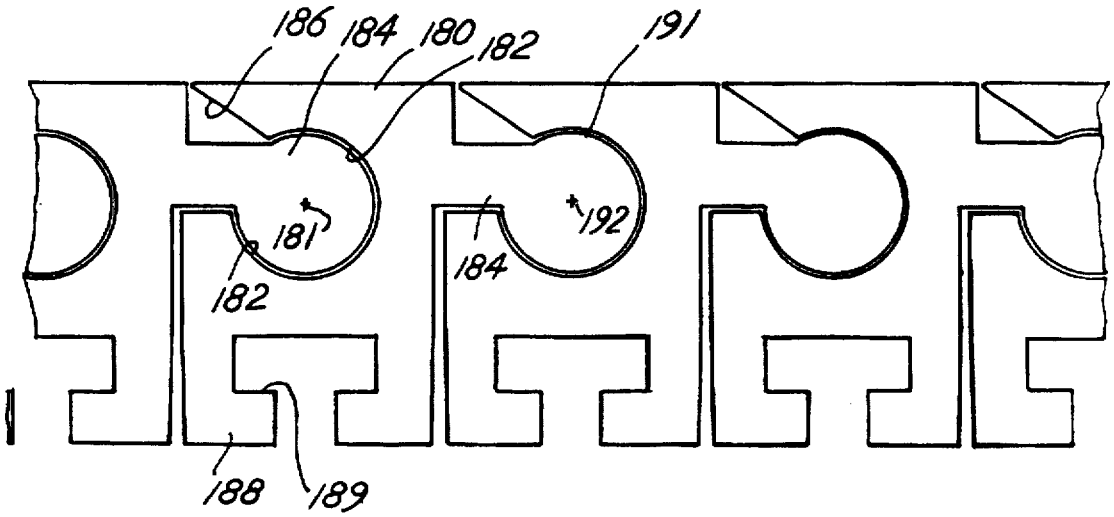
FIG. 5 is a cross-sectional view of alternative binder sections.

FIG. 5 illustrates an alternative construction of a binder section 180. Referring to FIG. 5, the binder section 180 includes an internal, shaped slot 182 designed to receive a rib 184 extending through an opening or lateral passage 186 in the section 180 and, in particular, the outer spine of the section 180. An inner channel 188 includes a T-shaped retention slot 189 that co-acts with an item holder or module. Again, as depicted in FIG. 5, the back sections 180 are constructed in a modular fashion. Thus, rib or projection 184 with axis 19 extends laterally from one side of section 180 and is spaced from the slot 182 having a center line axis 191 by a modular distance of at least equal or slightly greater than the lateral width of the section 180. As depicted in the figure, any desired number of sections 180 may be interconnected in the manner shown.

Figure 6:
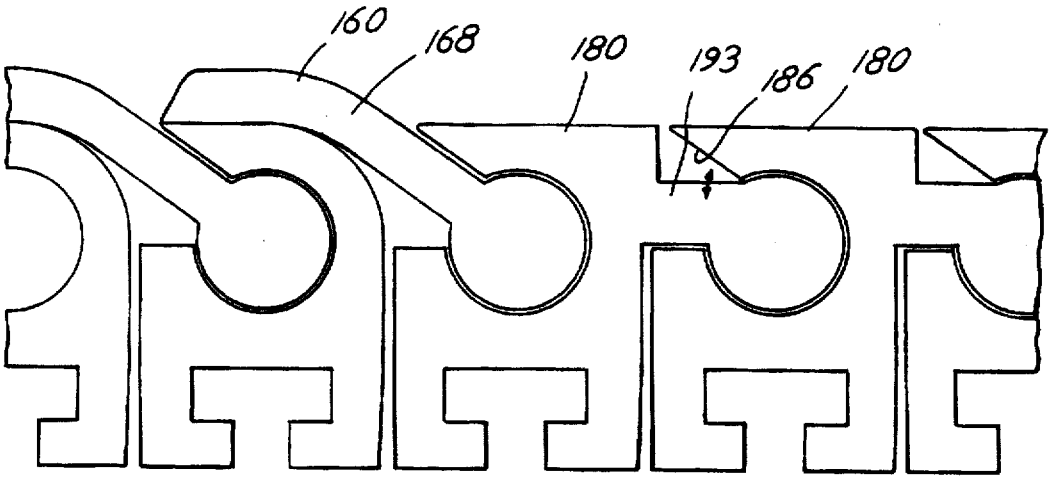
FIG. 6 depicts a cross-sectional view of yet another binder section construction.

FIG. 6 depicts interconnection of back sections 180 and 160. The flexibility of the arms of 168 facilitates the movement of the assembly so that it may be opened in book-like fashion. The sections 180 may include a shaped opening or slot 186 wherein there is limited room for the arm 193 to move in a slot 196 so as to restrict rotative movement of sections 180 which are interconnected one with respect to the other using the alternate construction depicted. Thus, binder sections may be connected to form a rigid or a flexible assembly.

Figure 7:
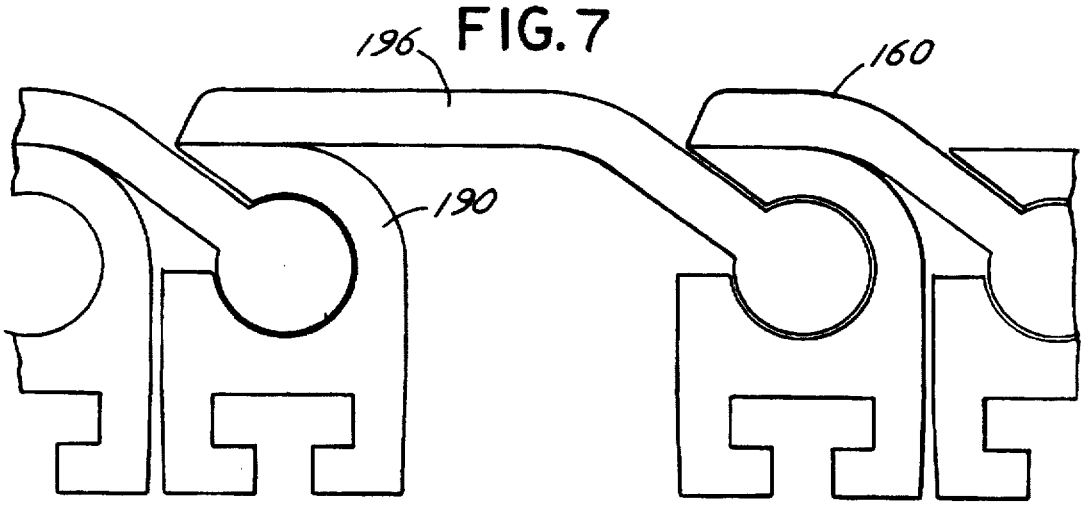
FIG. 7 is another alternative binder section construction in cross-section.

FIG. 7 depicts another variation wherein back sections 160 are adapted to coact with similar sections 190 which have elongated laterally extending arms 196 to connect with adjacent modular sections 190 whereas to ensure that there is a space between adjacent sections connected by the arm 196.

Figure 8:
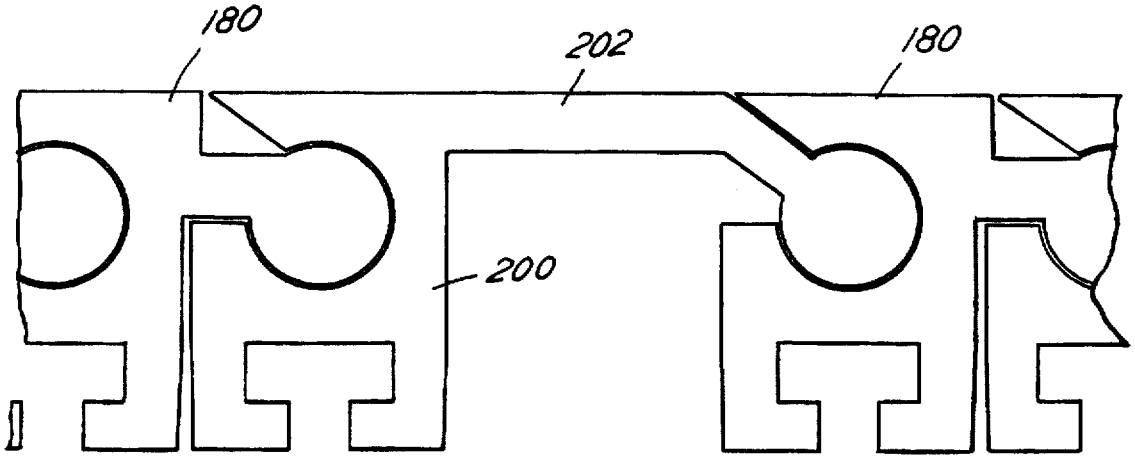
FIG. 8 is another binder section construction in cross-section.

FIG. 8 discloses a similar construction with sections 180 of the type shown in FIG. 5. Thus in FIG. 8, section 200 includes a laterally extending arm 202 that has a lateral extent significantly greater than the modular width of a section 180 and/or 200.

Figure 9:
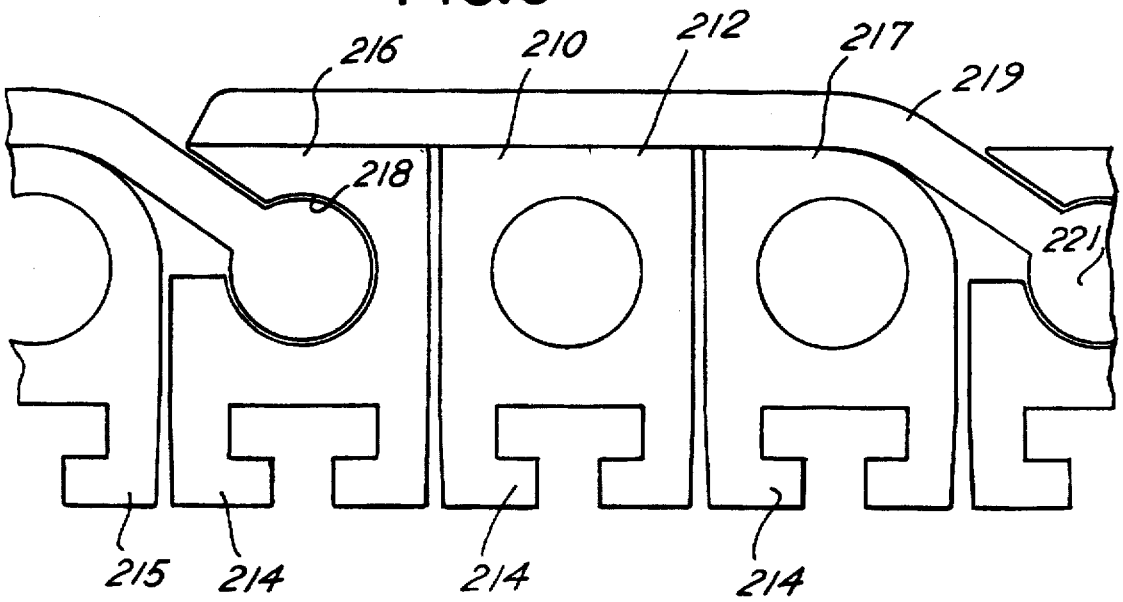
FIG. 9 is a further variation of a binder section in a cross-sectional view.

FIG. 9 is a cross-sectional view of yet another construction of the modular binder back sections. In FIG. 9, a multiple section 210 includes a center section 212 with an inner retention channel 214. Separate side sections 216 and 217 are attached on opposite sides of the center section 212, each having a channel 214. A slot 218 is provided for receipt of an extending arm 219 with a rib 221 of an adjacent section 215.

Figure 10:
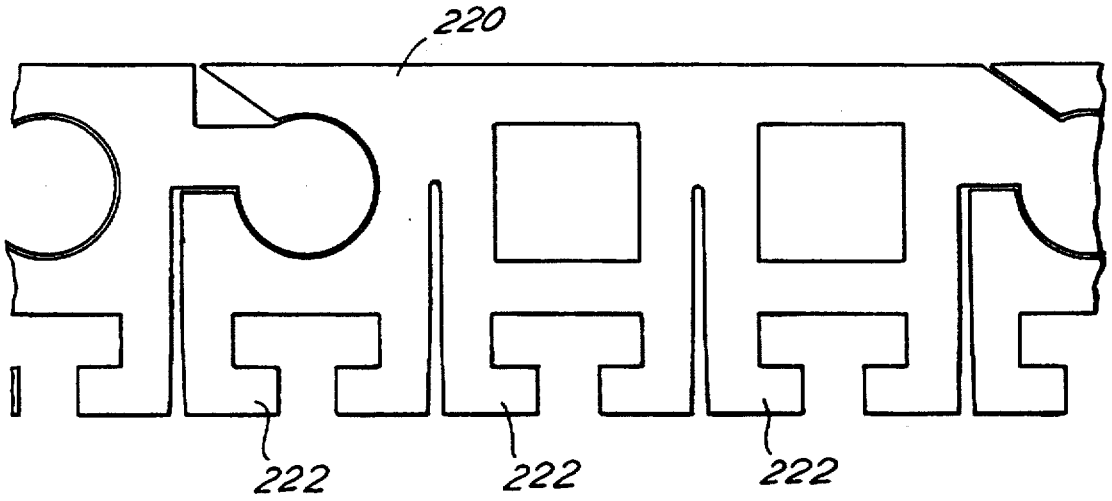
FIG. 10 is another cross-sectional view of a variation of the binder section construction.

FIG. 10 discloses a variation wherein a modular binder back section 220 similar to the elements of FIG. 5 is provided with multiple channels 222. Molded with section 220 of FIG. 10 are three laterally adjacent inner retention channels 222.

Figure 11:
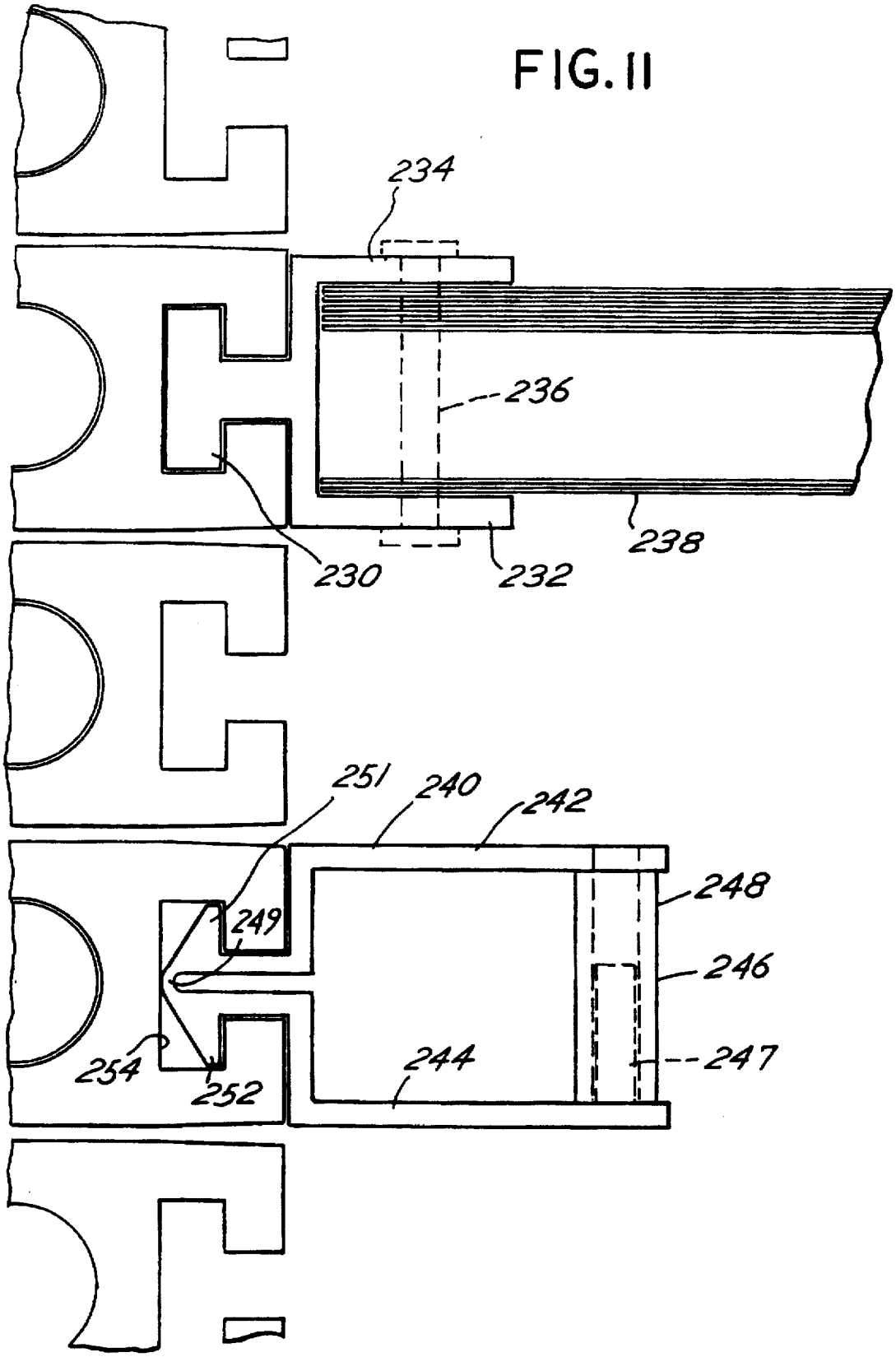
FIG. 11 is a cross-sectional view of the binder in combination with various internal item holders associated with the binder section.

FIG. 11 depicts various insert or item holders that may be used with the channel of a back section. For example, the item holder may comprise a T-shaped cross-section rib 230 attached to a pair of spaced flanges 232 and 234 that are adapted to receive a fastener or that has a fastener 236 so as to retain papers or other material in the item holder between the flanges 232 and 234. When assembling such a construction, pages 238 are punched with appropriate holes to accept fastener or pin 236. The pages 238 are then inserted between the flanges 232 and 234 and the pin 236 inserted therein. Thereafter, item holder is attached to a modular binder back element by sliding the key section or rib 230 into the appropriate slot associated with the binder back section.

An item holder may also be fabricated as depicted in FIG. 11. Specifically, holder 230 may be formed of pre-molded plastic with spaced flanges 242 and 244 and integrally molded fasteners or pins 246 that are comprised of projections extending in opposite directions from the flanges 242 and 244, along with a lug 247 and receptacle 248. The separate flanges 242 and 244 are connected together by a living hinge 249, which is integrally molded with the item holder 240. Further integrally molded therewith, on opposite sides of living hinge 249, are coacting tabs 251 and 252 that comprise a mechanism for retaining the item holder in closed position when the flanges 242 and 244 are arranged in parallel. Among the benefits of this item holder construction is that the item holder 240 is retained in a closed tight position about materials by virtue of the coaction between the inner retention slots 254 and the folded hinge 249 when inserted into the T-shaped slot or channel of a back section 50 or any other back section of similar construction.

Figure 12:
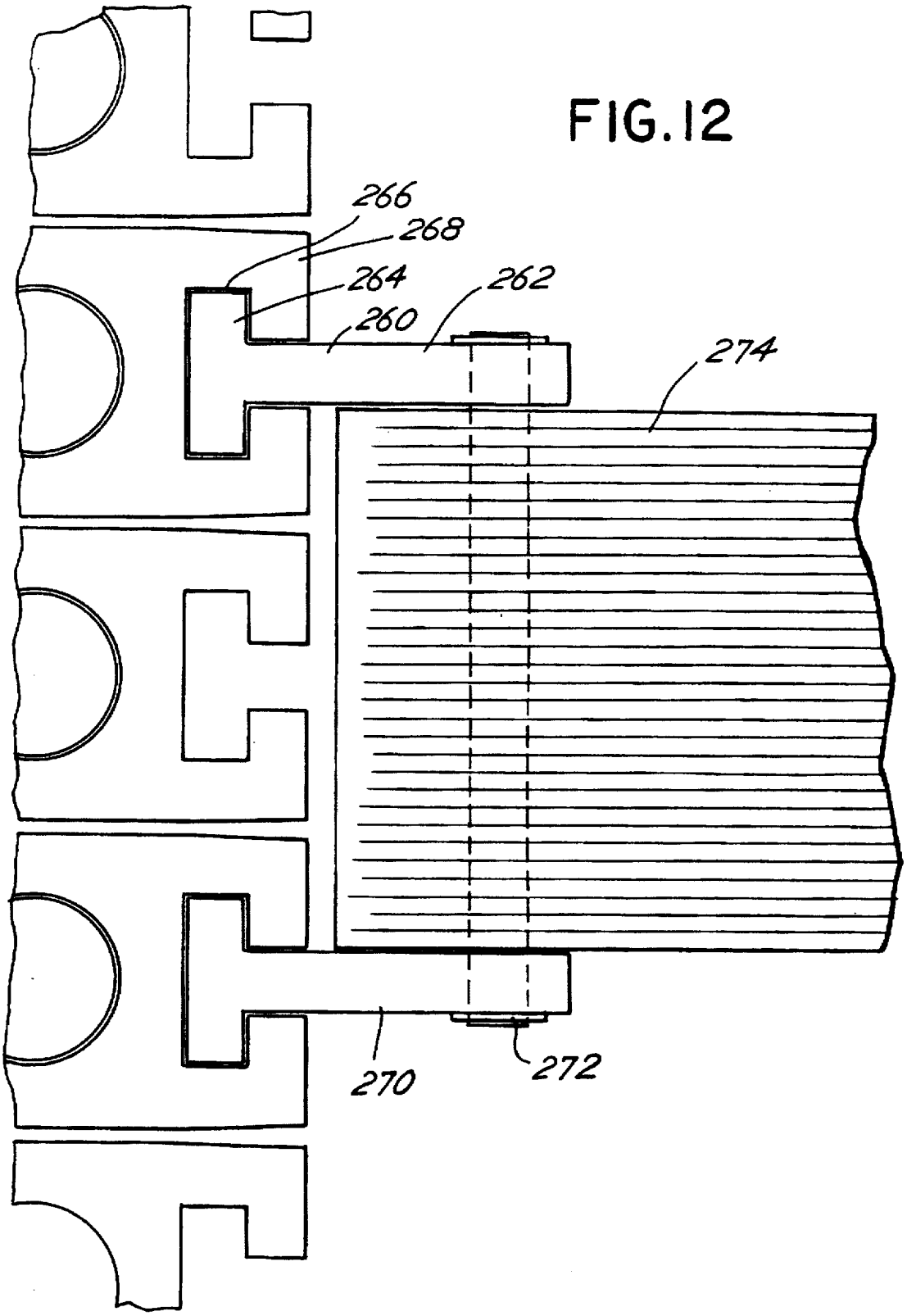
FIG. 12 depicts an alternative construction of an item holder associated with a binder section configuration.

FIG. 12 illustrates another item holder; specifically, a holder or module 260 that includes a projection flange 262 and crossbar 264 adapted to slide and to fit into a slot 266 defined in the inner retention section 268 of one of the modular binder back sections. A similar item holder 270 may be positioned in a back section, i.e. section 50. The holders 260 and 270 are substantially identical and are adapted to receive a pin or a fastener 272 therebetween. The holders 260 and 270 may be spaced any desired distance apart to accommodate any particular collection of pages or other materials 274.

Figure 13:
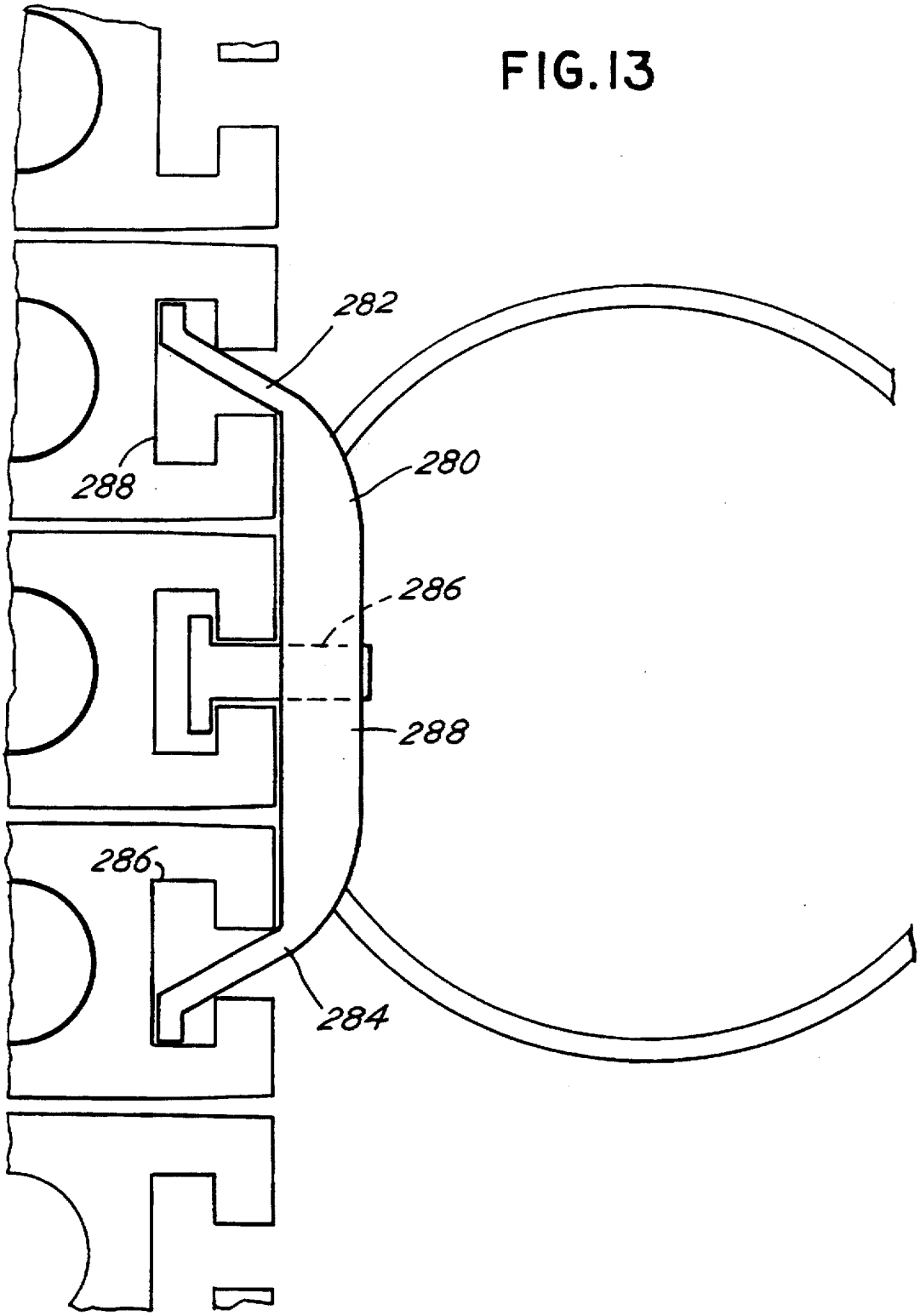
FIG. 13 depicts another alternative configuration of item holders in combination with a binder section.

FIG. 13 illustrates another possible assembly wherein a three-ring binder insert 280 includes depending flanges 282 and 284 that are modularly spaced to coact with T-shaped slots 286 and 288 in a back section. The three-ring binder 280 may optionally include a pin or retention bar 286 connected to the center plate 288 of the three-ring binder 280 and adapted to engage a T-slot of a back section.

Figure 14:
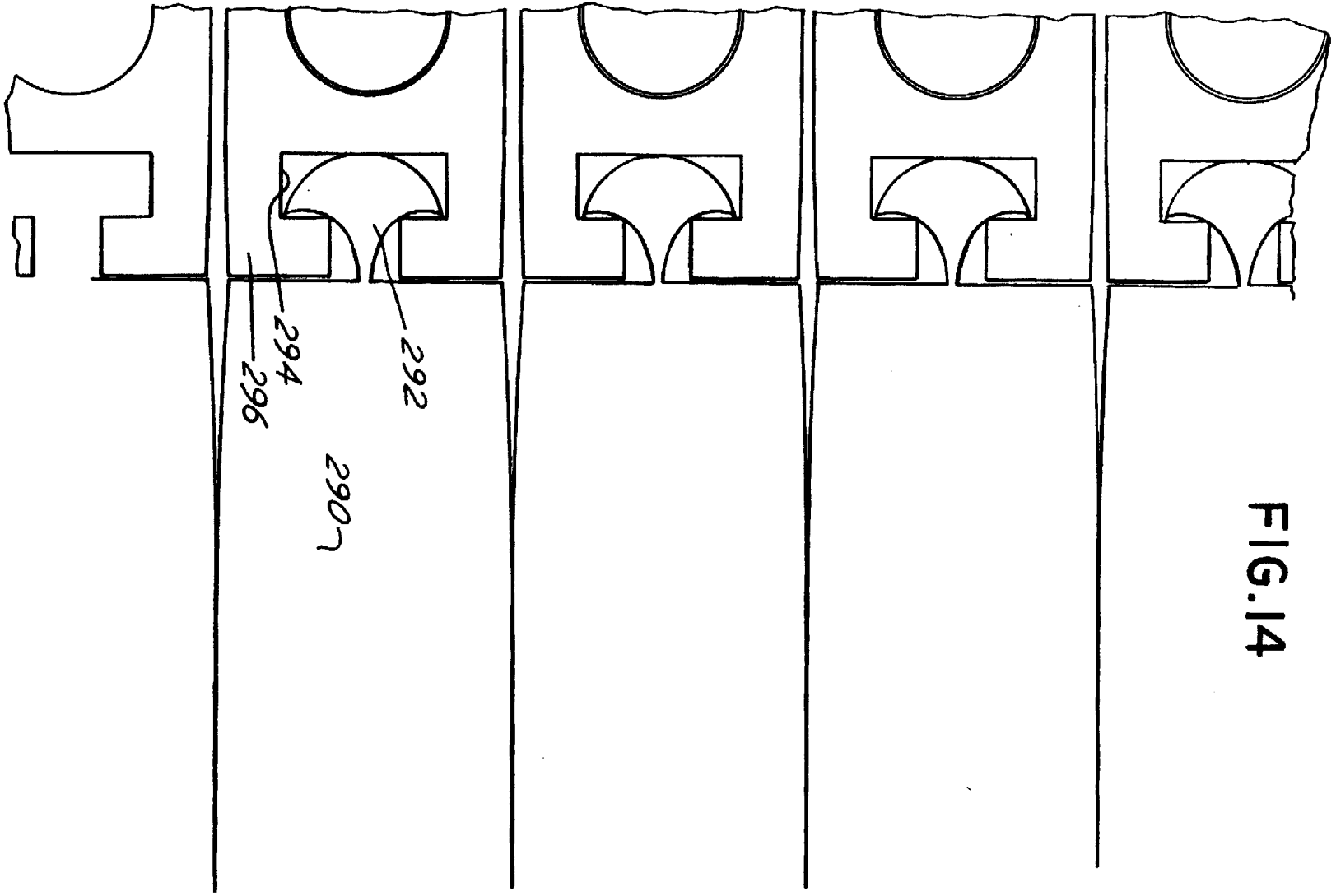
FIG. 14 is a further variation of the item holder used in combination with the binder section.

FIG. 14 depicts a construction for retaining expanding files in combination with modular binder back sections. Thus an expanding file 290 may include a shaped rib 292 which is coactive with a T-shaped slot 294 of a section 296.

Figure 15:
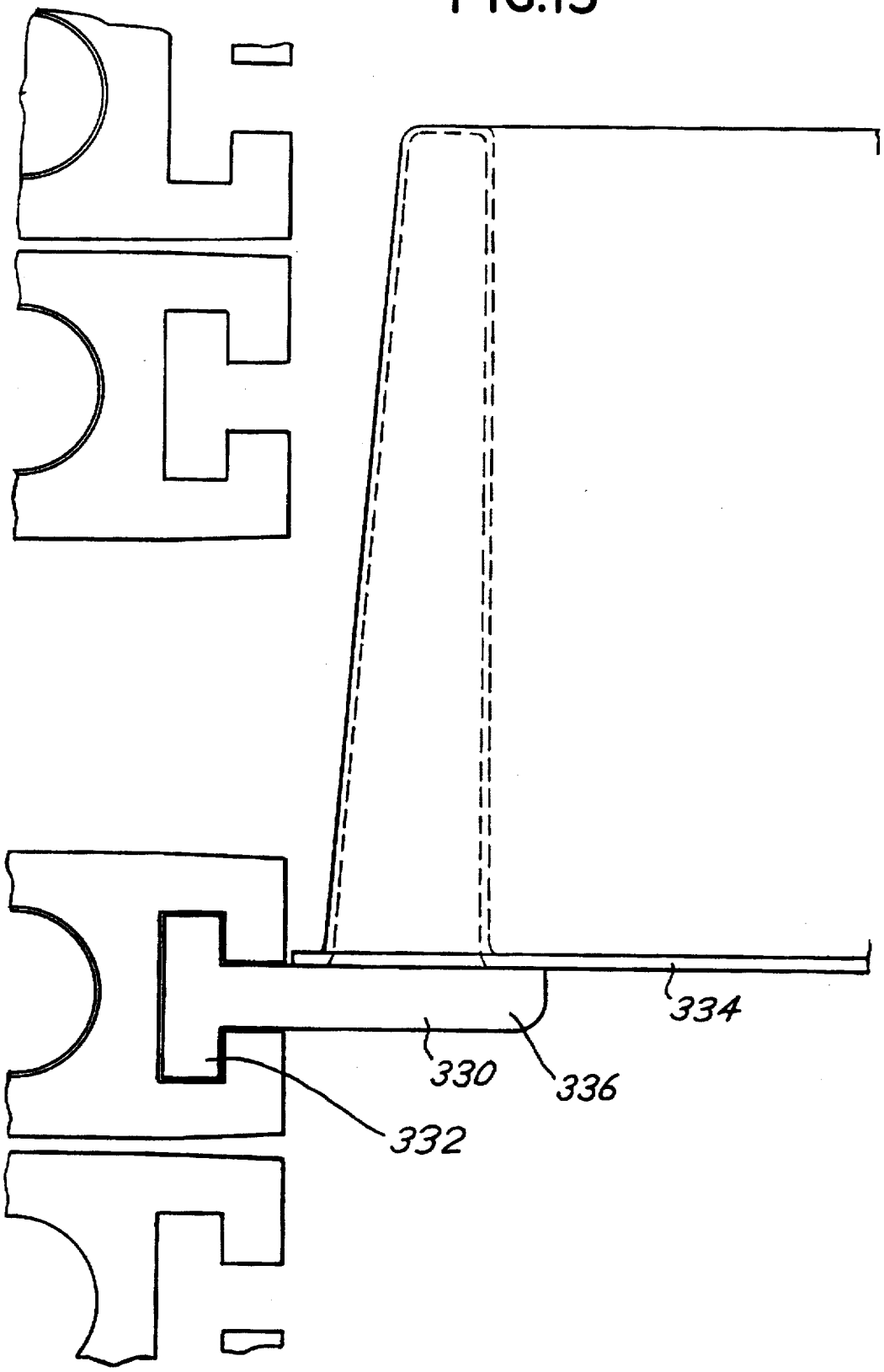
FIG. 15 is another alternative item holder used in combination with the binder section.

FIG. 15 depicts yet another variation of an item holder or module. Module 330 includes a T-shaped rib 332. The module 330, however, also includes a molded retainer tray or box 334 which is affixed to a projection arm 336 of the holder 330.

Figure 16:
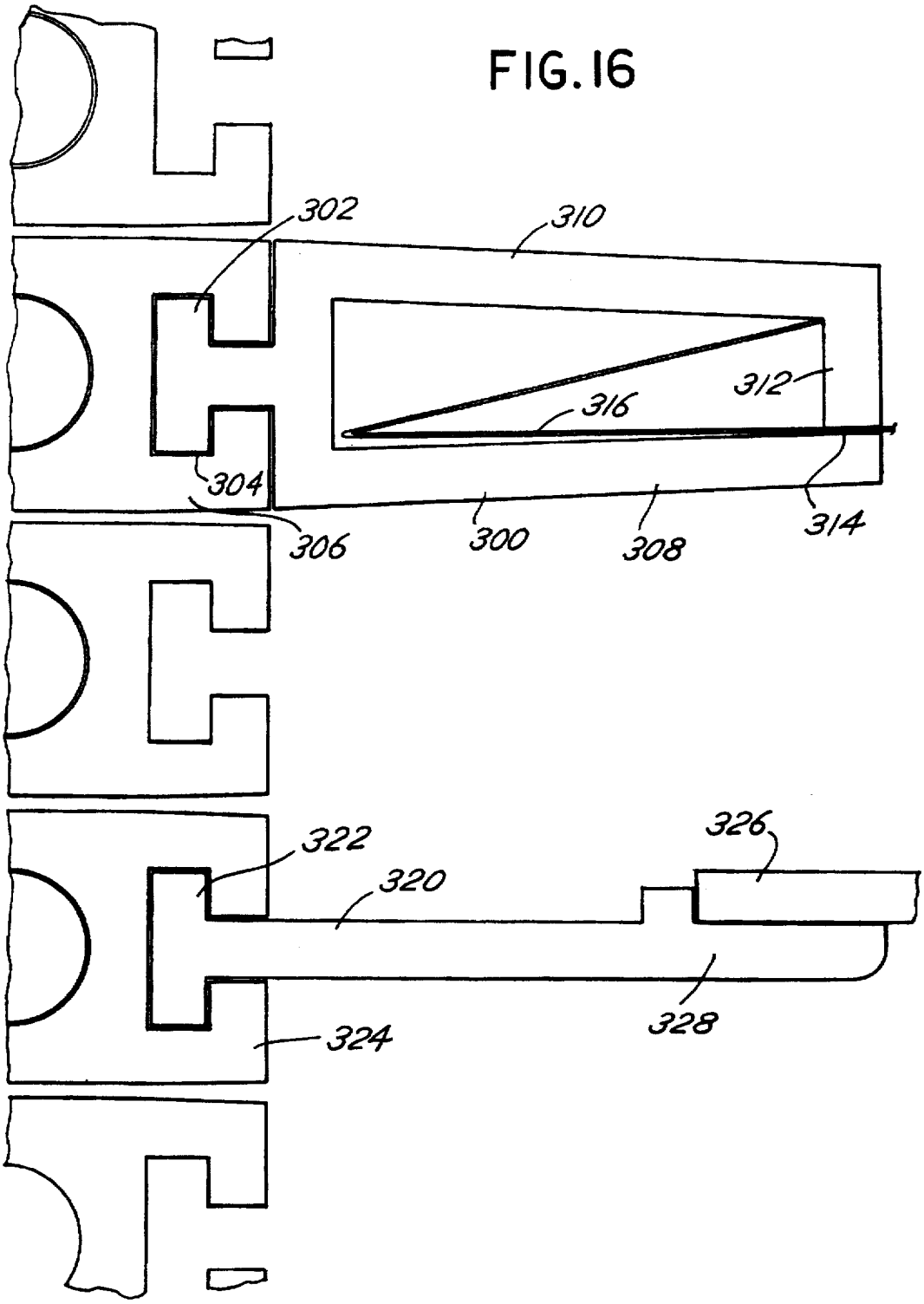
FIG. 16 is a further variation of the various item holders that may otherwise be used in combination with the binder sections.

FIG. 16 illustrates yet an additional possible item holder or module. Module 300 includes a T-shaped rib 302 cooperative with the T-shaped slot 304 of a back section 306. The module 300 further includes opposed flange members 308 and 310 which are spaced one from the other to define a space therebetween. A lateral flange 312 projecting from flange 310 towards flange 308 defines a narrow slit therebetween, namely slit 314. The folded edge of a paper or board 316 may be inserted through the slit 314. Since the element 300 is fabricated from molded plastic and is slightly flexible yet tends to retain its molded shape, the edge of the paper 316 will be gripped and retained within the module 300.

Also depicted in FIG. 16 is a holder 320 which includes a T-shaped rib 322 for coaction with a back section 324 T-shaped channel. The holder 320 is adapted to receive a cover or sheet 326 of cardboard which may be attached by glue or other means at the end of flap or flange 328 of the holder 320.

Figure 16A:
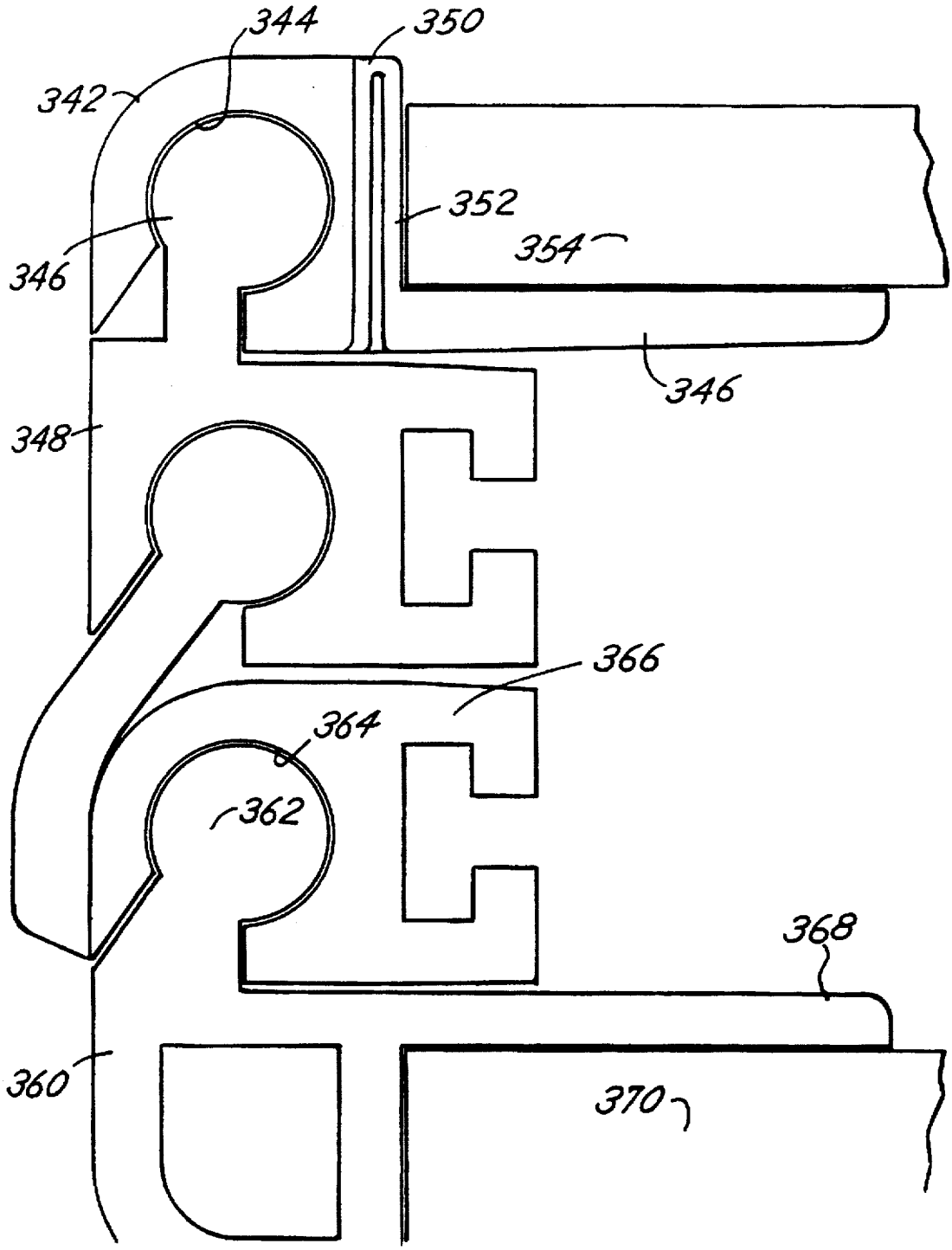
FIG. 16A is a depiction of a binder section in combination with a cover for the binder.

FIG. 16A depicts various constructions of back sections in combination with end or cover constructions that may be used to provide front and back covers for an assembly comprised of elements of the type previously described. Thus a cover element 340 includes a connector 342 which includes a longitudinal slit 344 for receipt of a rib 346 associated with one of the backing sections 348. The cover section or element 340 further includes a molded living hinge 350 which connects to a molded cover or alternatively to a molded plastic tray or receptacle 352 which is adapted to receive and hold a cover 354, for example.

FIG. 16A also depicts another variation of a cover construction. Here the cover element 360 includes a rib 362 which co-acts with a slot 364 of a back section 366. The cover element 360 includes a longitudinal flange 368 adapted to receive the cover 370. Since the cover 370 is most likely flexible, there is no need to include a living hinge, though such a hinge 350, also depicted in FIG. 16A, may be provided.

FIGS. 17 through 31 illustrate further features of the item holders; especially features associated with item holders of the type depicted in FIG. 11 as holder or module 340. Thus referring to FIG. 19, there is shown an item holder 350 which includes opposed flanges 352 and 354 connected together by a hinge 356. Integrally molded as part of the module 350 and on opposite of the hinge 356 are projecting tabs 358 and 360 the assembly is pre-molded. The assembly may be opened so that the flanges 352 and 354 are planer. When folded about the living hinge, however, the configuration assumes the shape and arrangement depicted in FIG. 19. As such, it may be inserted into a binder back section such as depicted in FIG. 11. Alternatively, a backing spine 362 as depicted in FIG. 18 which is a pre-molded plastic element, may be utilized and fitted over the folded 358 and 360 of FIG. 19. Thus, the backing spine 362 has a convex outer face 364 and inwardly projecting lips or flanges 366 and 368 which coact with and fit into the slots defined by the tabs 358 and 360. As shown in FIG. 18, the flanges 352 and 354 may also be adapted to receive a cover 370 and 372, respectively.

FIG. 17 depicted a supplemental construction for the molded flanges 352 and 354. That is, the flanges and 352 and 354 are connected by means of integrally molded living hinges 374 and 376. Thus a living hinge 375, sucha s depicted in FIG. 18, is positioned where the flange is connected to the befinning of the tab construction. The covers 378 and 380 are also integrally formed with the item holder. The covers 378 and 380, however, include cut-out sections 382. The cut-out sections 382 are designed to retain pages in combination with a flanged section 384 by means of projecting binder members 386. The binder members 386 may then be utilized to retain papers, for example, between flanges 382, 384. The covers 378, 380, however, may be opened. The entire assembly may be combined or retained by a back section 362 or may be combined with the back sections 50 and the like previously described.

Figure 20:
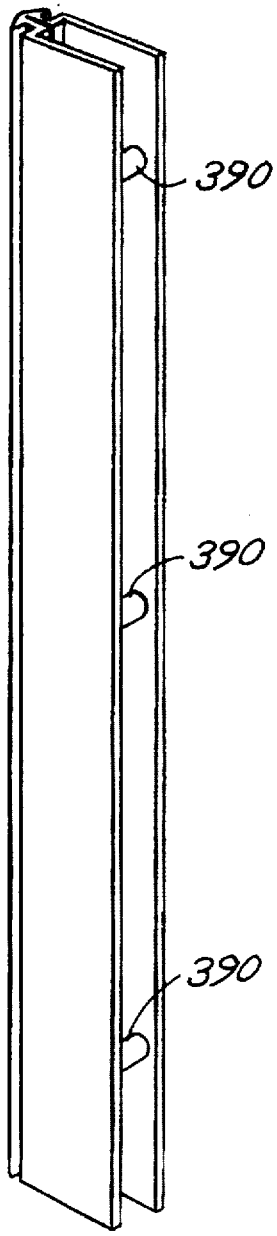
FIG. 20 is a perspective view of the holders shown in FIG. 19.
Figure 21:
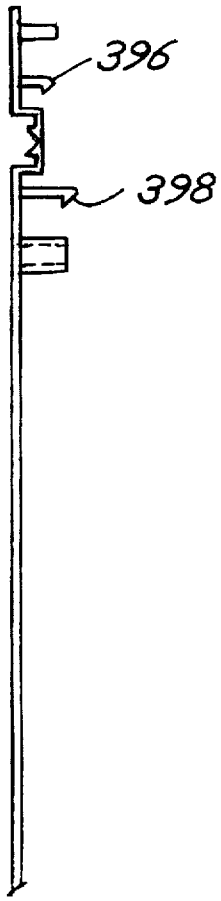
FIG. 21 is a cross-sectional view of the elements depicted in FIG. 20.

FIG. 20 depicts the construction of FIG. 19 and the manner by which fastening elements 390 are integrally molded with the flanges 352 and 354. FIG. 21 depicts the construction of FIG. 20 wherein the holder is depicted as it is molded. The cover may be integrally molded with the holder or separately molded.

Figure 22:
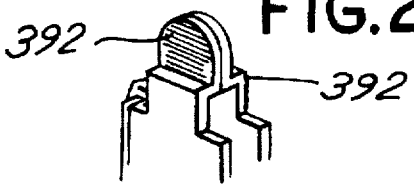
FIG. 22 is an alternative end construction and isometric view of the holder depicted in FIG. 20.
Figure 23:
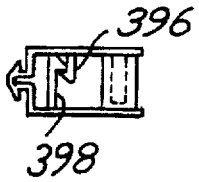
FIG. 23 is a cross-sectional view taken substantially along the line 23—23 in FIG. 24.
Figure 24:
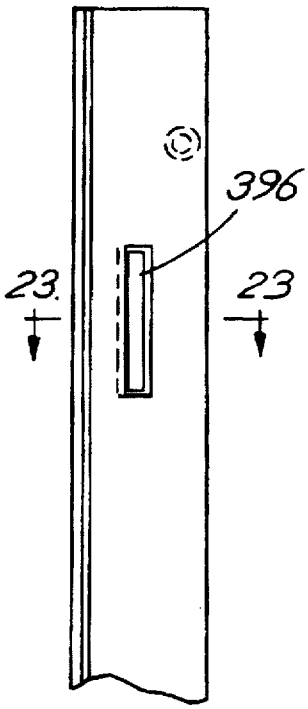
FIG. 24 is a side elevation of an alternative embodiment of the construction of FIG. 20.

FIG. 22 depicts additional features that may be incorporated in of the holder depicted in FIG. 20. Specifically, pull-out tabs 392 may be integrally molded at the end of the holder. This facilitates placement of the holder in a back element or removal therefrom. FIGS. 23 and 24 depict additional variations with respect to the holder construction described. That is, the holder may include projecting internal arms 396 and 398 which include overlapping tabs at the end so as to lock together and thereby retain in the holder in the assembled form such as depicted in FIG. 20. FIG. 24 depicts in a plan view the snap-lock construction depicted in FIG. 23.

Figure 25:
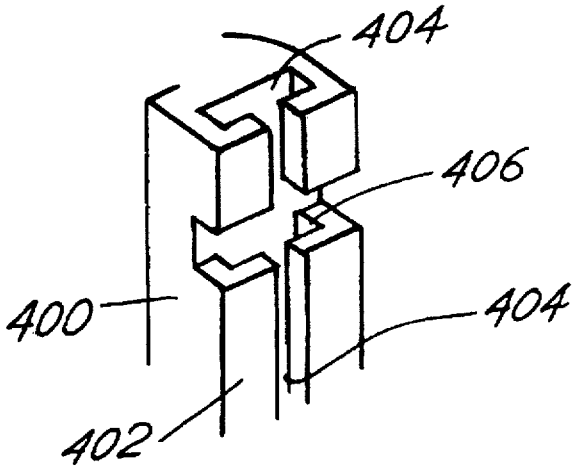
FIG. 25 is an isometric detail view of the construction of a channel designed to cooperate with the element depicted in FIG. 26.
Figure 26:
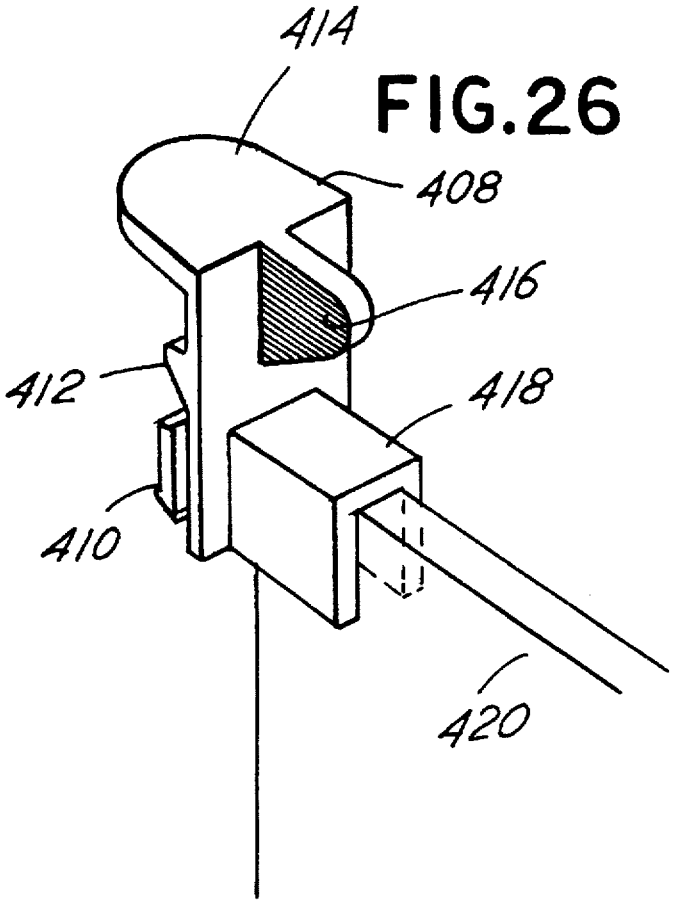
FIG. 26 is an element used in combination with channels depicted in FIG. 25.

FIGS. 25 and 26 depict some alternative constructions for mechanisms for retaining items within the backing sections. Thus, as shown in FIG. 25, a back section 400 may include an inner channel 402 having a T-shaped slot 404. At the end of the slot 404, a cross-slot 406 is provided. The cross-cut slot 406 is designed to coact with an element 408 as depicted in FIG. 26, namely an attachment element 408. The attachment element 408 thus includes a T-shaped flange 410 which fits into the T-shaped slot 404. The T-shaped flange 410 is inserted into the slot 404 from the top thereof and pushed downwardly. A projecting detent or tab 412 on the back side of the element 408 fits into the cross-cut 406 and thus locks the element 408 into position within the back section 400. The top flange or cover 414, as well as the pull tab 416, facilitate manual movement of the element 408. Projecting outwardly from the front of the element 408 is a retention slot 418 which is integrally molded with the element 408. The slot 418 may be adapted thereby to retain papers or the like by means of a pin, or the like.

Figure 27:
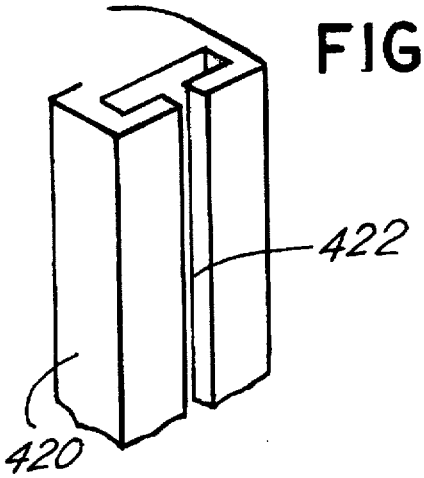
FIG. 27 is an enlarged perspective view of a channel holder element.
Figure 28:
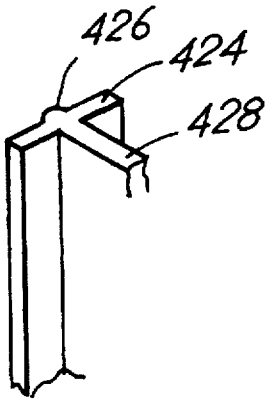
FIG. 28 is an isometric view of a holder cooperative of the channel of FIG. 27.

Referring next to FIGS. 27 through 31, various mechanisms are depicted that cooperate with back sections. Thus as shown in FIG. 27 there is a back section 420 having a T-shaped slot 422 for receipt of various item holders. As shown in FIG. 28, the holder that fits into slot 422 comprises a cross member 424 and a projecting bead or rib 426. An outwardly projecting flange 428 passes through the front section of the slot 422. The bead 426 serves to frictionally retain the configuration in the assembled condition.

Figure 29:
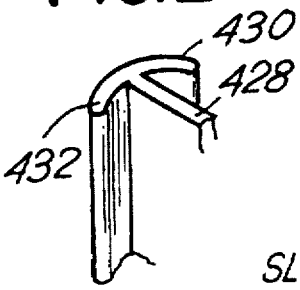
FIG. 29 depicts an alternative to the construction depicted in FIG. 28.

In FIG. 29, a forwardly extending flange 428 is attached to arcuate arms 430 and 432 which are elastic and thereby retain the item holder or module in combination with the back section 420.

Figure 30:
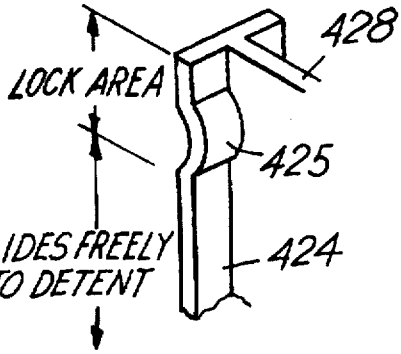
FIG. 30 depicts another alternative of the construction depicted in FIG. 28.
Figure 31:
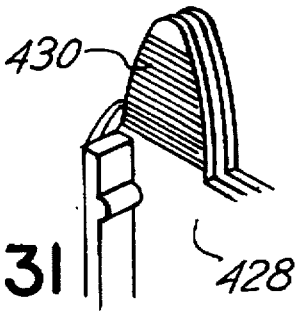
FIG. 31 is yet another isometric view of a holder which is an alternative of the construction of FIG. 28.

FIG. 30 illustrates yet a further configuration. In FIG. 30 lateral flanges 424 include an integrally molded detent 425 which coacts with the slot 422 to retain the item holder in position. In FIG. 31 there is illustrated pull-out tabs integrally molded at the end of flange 428. Thus tabs 430 are molded into the flange 428 to facilitate the insertion as well as removal of the item holder.

Figure 32:
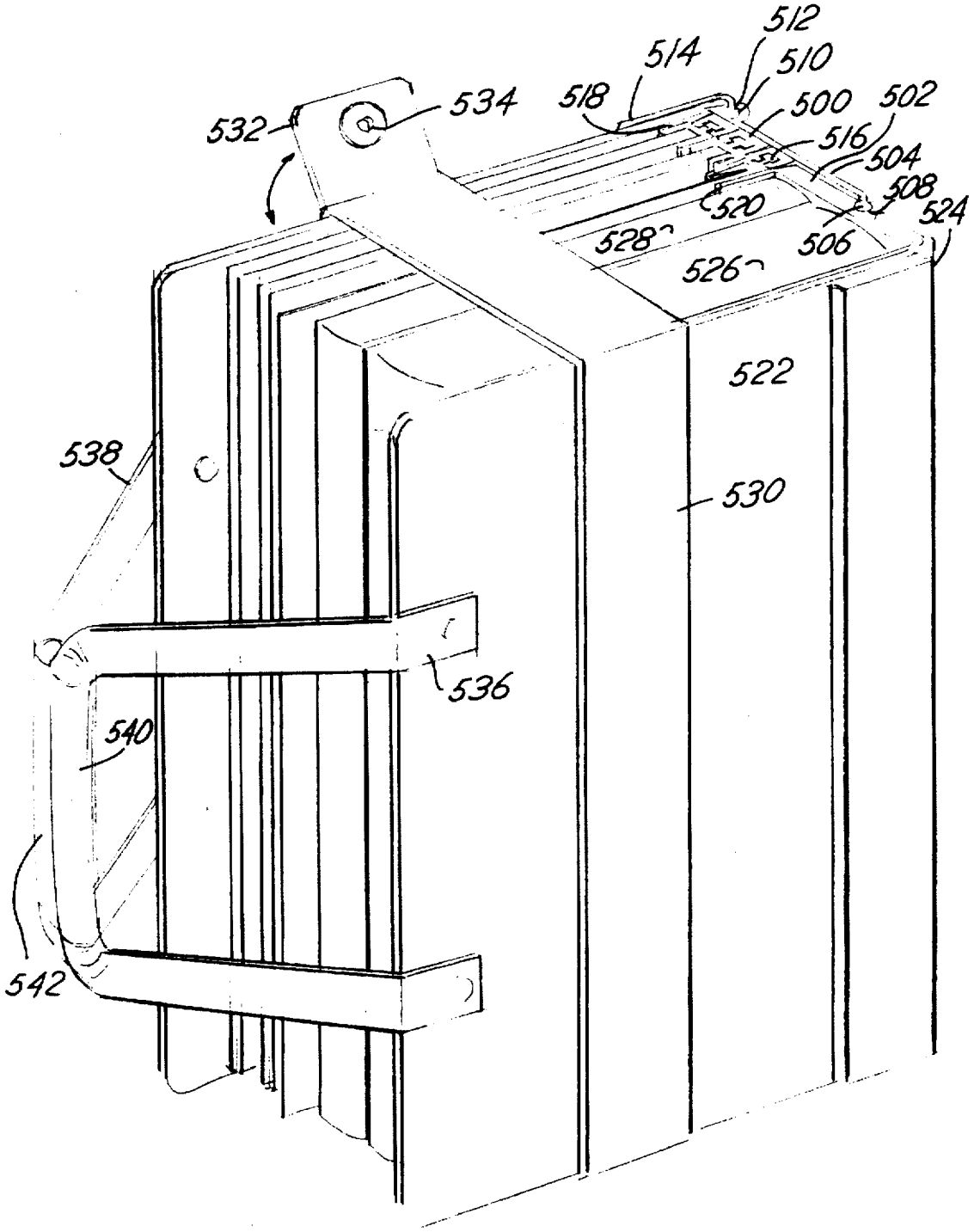
FIG. 32 is an isometric view of an assembled binder utilizing various binder sections; item holders and covers.
Figure 33:
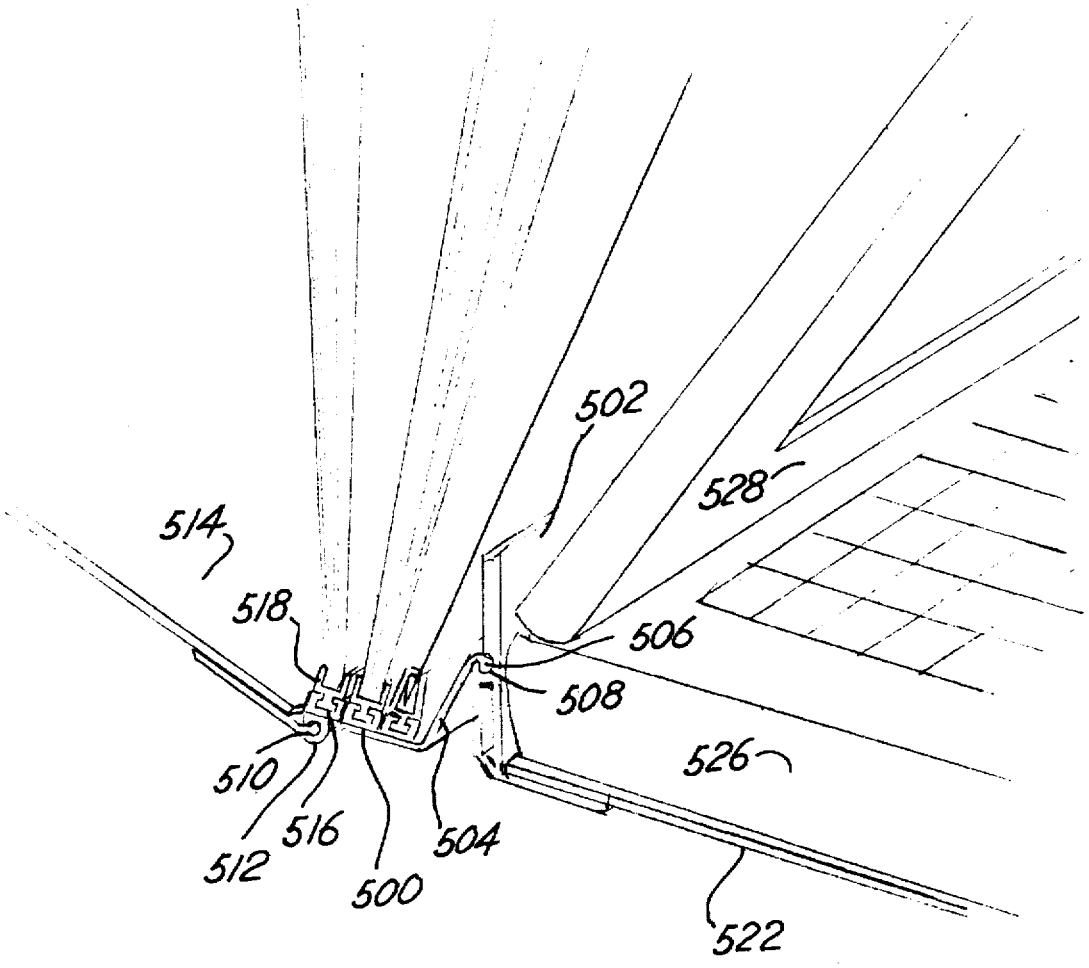
FIG. 33 is another isometric view of an assembled binder utilizing various binder sections and item holders.

Referring next to FIGS. 32 and 33, there is depicted a fully assembled binder comprised of a first binder section 500 and a second binder section 502 which are joined together to form the back or spine of a total binder assembly or system. Specifically the binder section 500 includes arm 504 terminating with a rib 506 which fits into a slot 508 associated with the binder section 502. The binder section 500 further includes a slot 510 which is adapted to receive a rib 512 associated with a cover 514. The binder section 500 further includes three (3) T-shaped channels such as channel 516 which cooperate with item holders such as the page item holder 518 or the single sheet item holder 520. The binder section 502 is comprised of a molded material and includes a cover 522 which is attached to the binder section 502 by an integrally molded hinge 524. The cover 522 surrounds or is attached to a molded lap-top computer case 526. Thus, the case 526 may be divided into separate portions 526 and 528 which will encapsulate a laptop computer, for example. Alternatively, the computer itself may be retained in the binder depicted in FIG. 32. Thus a strap 530 may be affixed to the cover 522 and the cover 514. 530 has a free end 532 which includes a fastening member 534 which cooperates with the fastener member (not shown) on the cover 514. Thus the computer or the computer container 526/528 can be easily retained within the binder. Cover 522 also includes a strap 536 attached thereto as does cover 514 include a strap 538. The straps 536 and 538 include handles 540 and 542 which may be joined together for example, by a Velcro fastener or a Velcro pad.

FIG. 33 depicts the assembly or binder of FIG. 32 in a partially opened position. Thus, the computer container or computer itself 526/528 may be opened by moving the section 522 about the axis defined by the rib 506. In this manner, access to the computer may be obtained, as well as access to the other items retained by item holder 518, for example.

Figure 35:
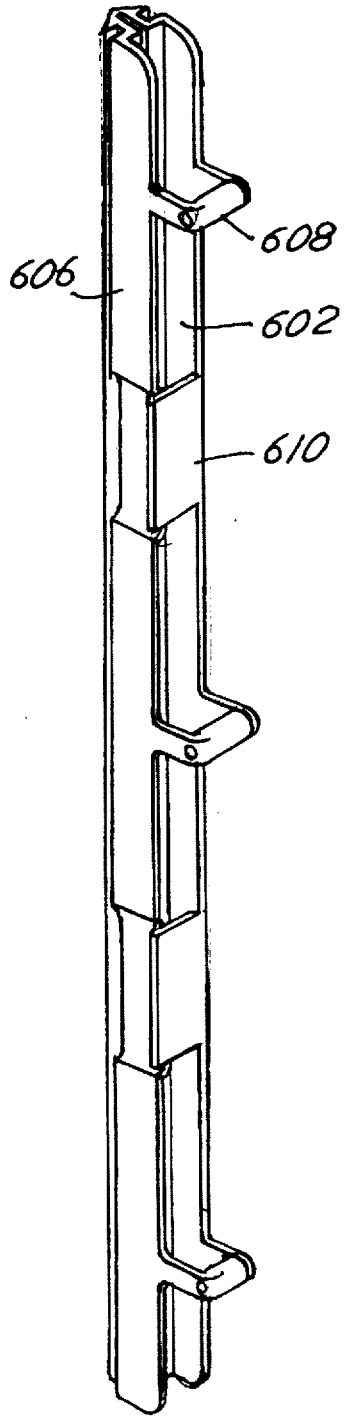
FIG. 35 is an isometric view of the item holder of FIG. 34 in an assembled condition.
Figure 34:
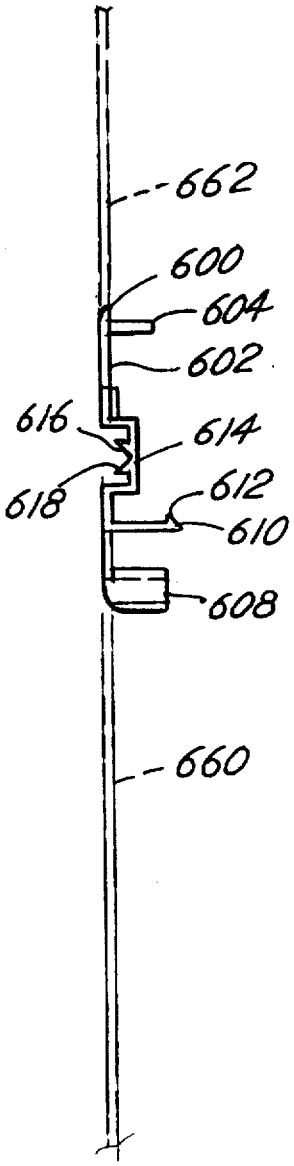
FIG. 34 is an end view of a special item holder.
Figure 36:
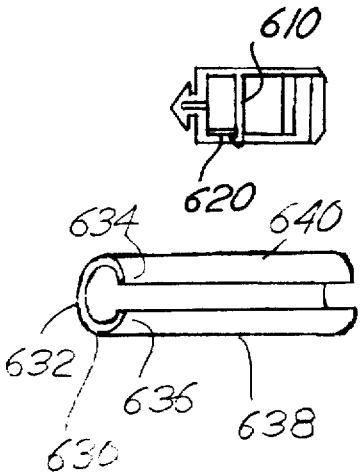
FIG. 36 is a cross-sectional view of the item holder of FIG. 35 in combination with a binder sections.

FIG. 34 illustrates a construction of an item holder similar to that depicted in FIG. 21 and FIG. 20. FIG. 35 illustrates the item holder of FIG. 34 in a folded or assembled condition designed to hold pre-punched three-hole paper, for example. FIG. 36 illustrates the item holder of FIG. 34 and 35 as it would be combined with a potential single binder section having integrally molded or formed covers therewith.

Thus referring to these figures, the item holder 600 includes a first lateral extension 602 with a projecting pin 604. The extension or flange 602 is connected to a mirror image flange 606 which includes a pre-molded receptacle 608 adapted to receive and interlock with pin 604. A locking arm 610 with a locking lip 612 is also molded in the flange 606. A living hinge 614 connects the flanges 602 and 606 of the section adjacent the living hinge 614 includes molded projections 616 and 618 which form a generally T-shaped member shown in FIG. 36 for cooperation with a binder section as described below.

The channel 600 further includes a rib 620 cooperative with the lip 612 of the arm 610, again as depicted in FIG. 36. When the assembly of FIG. 34 is locked in the position depicted in FIG. 35 and maintained in that position to hold sheets of paper, for example, the coacting pin 604 and recess 608 in combination with the arm 610 coacting with the rib 620 hold the assembly or channel in the locked position depicted by FIG. 35. When in this position, the channel 600 may be inserted into a binder section 630, which includes a spine 632 and inwardly extending ribs or legs 634 and 636 that fit over the T-shaped retention arms 616 and 618 as they are formed by folding the channel about the hinge 614. Covers 638 and 640 may be integrally molded with the binder section 630. Note that the width of the channel depicted in FIGS. 31, 35 and 36 may be varied in the same modular fashion as the binder sections previously described. Thus the channel may be fitted into one or more modular widths of the binder sections. Also a cover may be molded integrally with the channel. For example, a cover 660 and 662 may be integrally molded with the channel 600 as depicted in FIG. 34. The channel 600 also may be provided with various hole patterns or in other words, various arrangements of pin 604 and receptacle or detent section 608.

Many variations of the described construction are possible. Potential elements of the construction include, but are not necessarily limited to, the modular back sections which include sections that are designed to permit opening and closing of the assembly, much like a book. The item holders may have multiple types of construction as described for holding multiple types of materials. The assembly may be utilized to provide a binder for multi-media presentations. It may be used as a photo album. Computer disks may be retained as may cassettes and video discs. There are a myriad of uses of the product. Thus the apparatus or assembly of the invention constitutes a system which is modular, expandable, may be changed or updated, may include multiple accessory options, may include the ability to combine various components, all in a common binder. The back elements may provide both a flexible, as well a solid binder or spine. If the binder is solid, or rigid, the item holders may be flexible. Alternatively, the item holders may be generally rigid and the spine may be flexible or book like. Further, all of the components are interchangeable and the width of the system may be varied according to need. Thus while there has been set forth numerous embodiments of the invention, it should be understood that the invention is to be limited only by the claims and equivalents.

What is claimed is:

1. A modular binding system comprising in combination:

a back section including a longitudinal spine, a lateral slot on one side of the spine and a lateral arm with a rib on the end of the arm on the other side of the spine, said rib sized to slidably fit in the slot whereby multiple back sections may be attached together side by side by engaging the rib and slot of adjacent sections;

said back section further including a longitudinal shaped channel intermediate the rib and slot; and an item holder slidably engaged with the channel, said item holder including a longitudinal flange on one side thereof, having a cross section congruent with the cross section of the shaped channel of the back section and said flange further including a cross bar means to hold the flange in the channel, said holder further including means for attaching an item to the holder on the opposite side thereof, said means for attaching being selected from a variety of alternatives.

* * * * *